137-13 SR
4/13/82 OR 4,324,266

United States Patent [19]
Garnier et al.
[11] 4,324,266
[45] Apr. 13, 1982

[54] PROCESS AND DEVICE FOR CONFINING LIQUID METALS BY USE OF AN ELECTROMAGNETIC FIELD

[75] Inventors: Jacques P. Garnier; Marcel A. Garnier, both of Grenoble; Rene J. Moreau, Voiron, all of France

[73] Assignee: Agence Nationale de Valorisation de le Recherche (ANVAR), Neuilly sur Seine, France

[21] Appl. No.: 154,425

[22] Filed: May 29, 1980

[30] Foreign Application Priority Data

May 31, 1979 [FR] France ..... 79 14011

[51] Int. Cl.[3] ..... B22D 41/08
[52] U.S. Cl. ..... 137/13; 137/827; 164/147.1; 222/594
[58] Field of Search ..... 137/13, 827, 251, DIG. 10; 417/50; 222/590, 594, 591; 164/48, 49, 146, 147

[56] References Cited

U.S. PATENT DOCUMENTS 3,463,365 8/1969 Dumont Fillon ..... 222/594
4,082,207 4/1978 Garniel et al. ..... 137/827 X

*Primary Examiner*—William R. Cline
*Attorney, Agent, or Firm*—Kontler & Grimes

[57] ABSTRACT

A device for confining liquid metals comprises a coil which surrounds a jet of liquid metal to be confined and means for causing an alternating current to flow through the coil. These means cause an alternating current to flow through the coil at a frequency which is less than the inverse of the product of the magnetic permeability of the liquid metal, the electrical conductivity of the metal and the square of the radius of the jet of the metal after confinement, in coherent units.

The invention applies to the casting of steel, aluminium, copper and alloys thereof.

10 Claims, 7 Drawing Figures

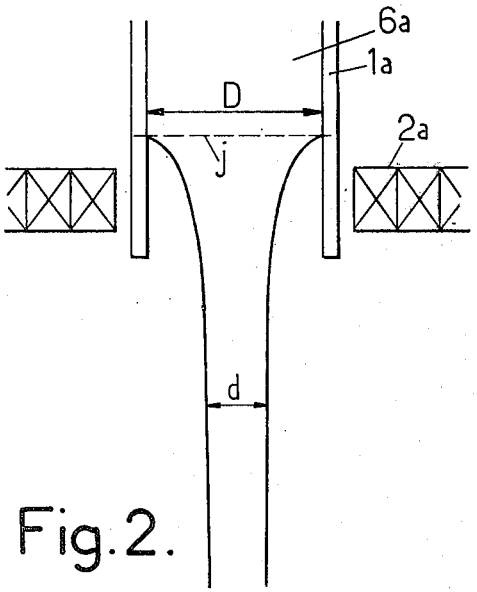
Fig.2.
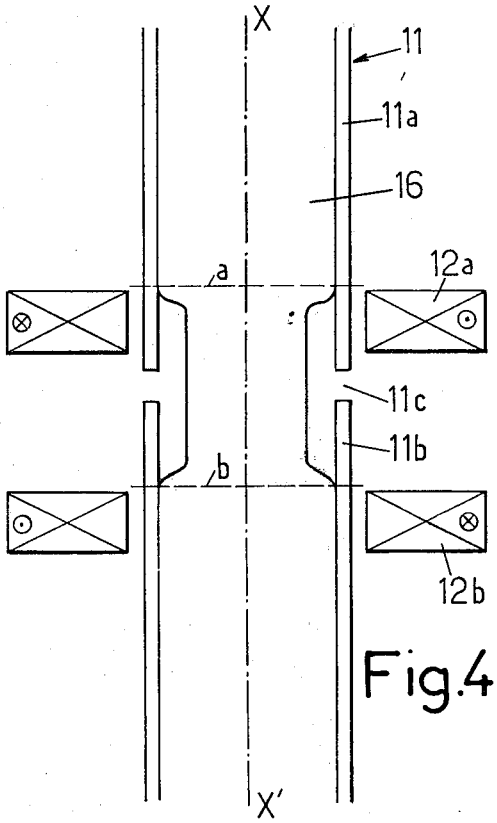
Fig.4.
Fig.5
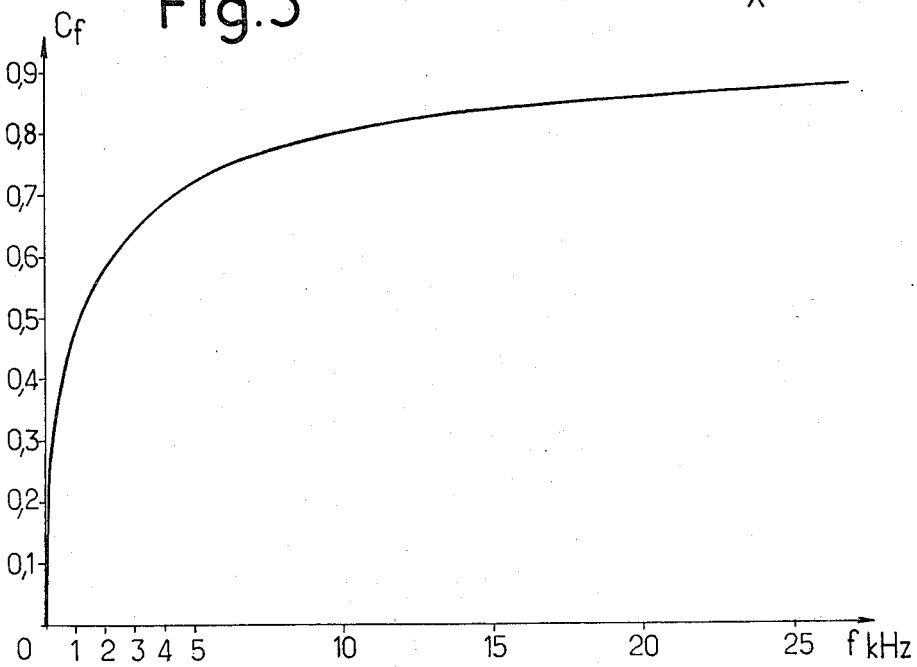

PROCESS AND DEVICE FOR CONFINING LIQUID METALS BY USE OF AN ELECTROMAGNETIC FIELD

BACKGROUND OF THE INVENTION

French patent application No. 2,316,026, filed on July 4, 1975 by the applicant and the INSTITUT DE MECANIQUE of Grenoble describes a device for confining a liquid metal jet. The device has a nozzle for forming the jet and is characterized by the fact that it comprises, in combination, means for creating an overpressure in the jet and means for discontinuing the overpressure. The means for creating the overpressure in the jet are formed by a coil surrounding the nozzle at the outlet thereof in combination with means for causing a high-frequency alternating current to pass through the coil.

The device in accordance with this patent application thus uses a combination of the following two means, for confining a jet of liquid metal a coil which surrounds the nozzle through which the jet flows and which has a high-frequency alternating current flowing therethrough, this coil creating an overpressure in the jet at the outlet of the nozzle, and means for discontinuing this overpressure.

It is stated in the above application that the frequency f of the alternating current which flows in the coil must be sufficiently high for the depth of penetration $\delta$ of the induction or magnetic field in the jet to comply with the following conditions:

$\delta < R$ and $\delta < e$,

R being the radius of the metal jet before contraction and e the thickness of the metal screen. The following relations then hold:

$$f > \frac{1}{\pi\mu\sigma_m R^2} \text{ and } f > \frac{1}{\pi\mu\sigma_c e^2},$$

with $\sigma_m$ and $\sigma_c$ representing the respective electrical conductivities of the metal which forms the jet (for example, steel or aluminium) and the metal which forms the screen (for example, copper) and $\mu$ designating the magnetic permeability of the liquid metal;

It is further stated in the above application that the means for discontinuing the overpressure in the jet is advantageously formed by a screen which is made from an electrically conducting material, is concentric with the coil and extends into the latter through the bottom (as considered in the direction of flow of the liquid metal). Means are provided for cooling the coil and the screen by removing the heat which is produced therein when the coil has an alternating current passing therethrough.

A french application related to the above-mentioned patent application, i.e. addition no. 2,396,612, filed on July 8, 1977 by the AGENCE NATIONALE DE VALORISATION DE LA RECHERCHE and the INSTITUT DE MECANIQUE of Grenoble, discloses means for regulating the flow of a liquid metal jet by using the device described in application no. 2,316,026. This is achieved by reducing the cross-section of the jet to a valve corresponding to the desired flow rate. Preferably the flow-regulating means are formed by means for varying the intensity of the high-frequency alternating current.

In both cases (original patent application and related application), means are provided for discontinuing the overpressure in the liquid metal jet. These means are advantageously formed by a cylindrical screen which is made from an electrically conducting material, is concentric with the coil and extends into the latter from the bottom (as considered in the direction of flow of the liquid metal jet).

U.S. Patent application no. 2,316,026 explains that the screen results in a sudden discontinuation of the magnetic induction and so discontinuation of the overpressure in the jet. This causes a reduction in cross-section of the jet because of the invariance of the flow rate $Q = SV$, on the one hand, and the pressure head (hydrostatic)

$$H = \frac{P}{\rho g} + \frac{V^2}{2g},$$

on the other hand, S being the cross-section of the jet, V the speed, P the pressure, and $\rho$ the density of the liquid metal, and g the acceleration of gravity. Thus, by reducing the pressure $\rho$ within the liquid metal jet, the flow speed V of the liquid metal is increased (because of the invariance of pressure head H) and the cross-section S (which is inversely proportional to the speed V because of the invariance of flow rate Q) is reduced.

The reduction in cross-section of the jet and accompanying separation of the jet from the nozzle takes place at the upper edge of the screen within the scope of the invention claimed in application Nos. 2,316,026 and 2,396,612.

SUMMARY OF THE INVENTION

The applicant has surprisingly discovered that a liquid metal jet may also be confined by using a low-frequency alternating current rather than a high-frequency current the latter being a current having a frequency complying with the above-mentioned inequalities. The low-frequency current has a frequency less than that at which the depth of penetration $\delta$ of the magnetic field into the jet of liquid metal is equal to the radius of the jet of liquid metal confined by the magnetic field. Thus, $\delta > r$, i.e.

$$f < \frac{1}{\pi\mu\sigma_m r^2},$$

$\mu$ and $\sigma_m$ having the same meanings as indicated above and r designating the radius of the liquid metal jet after contraction.

The applicant has discovered that the optimum frequency $f_o$ is that at which the depth of penetration $\delta$ of the electromagnetic field is equal to the radius R of the non-confined liquid metal jet, i.e.

$$f_o = \frac{1}{\pi\mu\sigma_m R^2},$$

The applicant has further discovered that at the above-mentioned low frequencies, and particularly close to the optimum frequency $f_o$, the screen is no longer indispensable, and confinement may be produced solely by the coil. However, in the absence of a screen, separation does not take place at a definite, stable level. The level at which the liquid metal jet separates from the inner wall of the nozzle may be stabilized by providing a screen which is concentric with the coil and extends into the coil from the top, and not from the bottom, (as considered in the direction of flow of the jet) as in patent application no. 2,316,526. Separation then occurs at the level of the lower edge of the screen.

To sum up, application no. 2,316,026 teaches a current of frequency $$f > \frac{1}{\pi\mu\sigma_m R^2}$$

in combination with a screen which extends into the coil from the bottom. Here, separation takes place at the level of the upper edge of the screen. According to the present invention, on the other hand a current of frequency $$f < \frac{1}{\pi\mu\sigma_m r^2}$$

(is used r is the radius of the jet after confinement and is less than R which is the radius of the jet before confinement) either with a screen which extends into the coil from the top or without a screen. In the absence of a screen, separation takes place at an indeterminable level whereas in the presence of a screen separation takes place at the lower edge of the screen.

French Pat. no. 1,188,576 filed on Nov. 12, 1957 by the company S. C. HERAEUS and Luxembord Pat. No. 66,760 filed on Dec. 28, 1972 by the CENTRE DE RECHERCHES METALLURGIQUES disclose processes and devices for casting a liquid metal in which the casting jet is contracted by means of a coil without using a screen. No precise information is given in these two patents regarding the frequency of the current which flows through the coil. A man skilled in the art cannot, then, know how to operate to achieve confinement of the liquid metal jet.

The applicant has discovered, on the one hand, that without a screen it is necessary to use an alternating current whose frequency is less than a certain value, and preferably close to a specific optimum frequency of $f_o$, and, on the other hand, that at these low frequencies the presence of a screen extending into the coil from above allows the level of separation to be fixed at the lower edge of the screen. None of this teaching for achieving correct and reliable confinement of a liquid metal jet is given in either French Pat. no. 1,188,576 or Luxembourg Pat. no. 66,760.

The concept of optimum frequency, which is important, also does not appear in the above-mentioned French Pat. no. 1,188,576 and Luxembourg Pat. no. 66,760.

At frequency above the optimum frequency, confinement is difficult, or even impossible, to obtain, except under unrealistic conditions where the metal jet is subjected to instabilities of great amplitude. At lower frequencies, confinement is possible (which explains why it is easy to choose a frequency leading to confinement) but requires very large power consumption. A plot of a coefficient $C_f$ representative of the efficiency of the magnetic field as a function of the frequency shows this. In fact, the more the frequency decreases below the optimum frequency, the more the efficiency of the magnetic field decreases. Thus, for a given power input to the coil, confinement will be achieved but with a coefficient of contraction which decreases with frequency. In other words, to obtain a given contraction, it is necessary to increase the power supplied to the coil as the frequency decreases with respect to the optimum frequency. The large increase in $C_f$ at low frequencies clearly indicates that even small reductions in frequency lead to a very large reduction in the efficiency of the magnetic field which must be compensated for by a large increase in the power supplied to the coil. Consequently, if not only the confinement phenomenon itself, but the industrial applications of the process and the device, and thus the economic aspects, are taken into account, the contribution of the invention with respect to the two latter patents is of prime importance because of the precise details which it gives concerning the optimum frequency.

The invention provides a process for confining a liquid metal jet in which an overpressure is created in the latter, substantially at the level where it is desired to achieve the confinement, by means of a coil surrounding the jet at this level and having an alternating current flowing therethrough. The process is characterized by the fact that the alternating current has a frequency less than the inverse of the product of the magnetic permeability of the liquid metal, the electrical conductivity of this metal and the square of the radius of the jet of this metal after confinement, in coherent units.

Preferably, this frequency is substantially equal to the inverse of the product of the permeability, conductivity and square of the radius of the metal jet before confinement, in coherent units.

The invention also relates to a device for confining a liquid metal jet by use of the above-mentioned process comprising a coil which surrounds the jet and means for causing an alternating current to flow through the coil. These means cause an alternating current to flow through the coil at a frequency which is less than the inverse of the product of the magnetic permeability of the liquid metal, the electrical conductivity of this metal and the square of the radius of the jet of this metal after confinement, in coherent units.

The above means preferably cause the alternating current to flow at a frequency substantially equal to the inverse of the product of the permeability, conductivity and square of the radius of the metal jet before confinement, in coherent units.

Advantageously, the device further comprises a screen which is made from an electrically conducting material, is disposed concentrically with respect to the coil and extends into the latter from the top as considered in the direction of movement of the jet.

The invention will be better understood with the help of the description which follows, as well as the accompanying drawings, which are, of course only exemplary.

BRIEF DESCRIPTION OF THE DRAWING

FIGS. 2, 3 and 4 are sectional views of three different embodiments of a device in accordance with the invention.

FIG. 5 is a plot of a coefficient $C_f$ representing the efficiency of the magnetic field as a function of alternating current frequency in KHz for a stream of liquid steel having a diameter of 40 mm.

DESCRIPTION OF THE PREFERRED EMBODIMENTS

Figure 1:
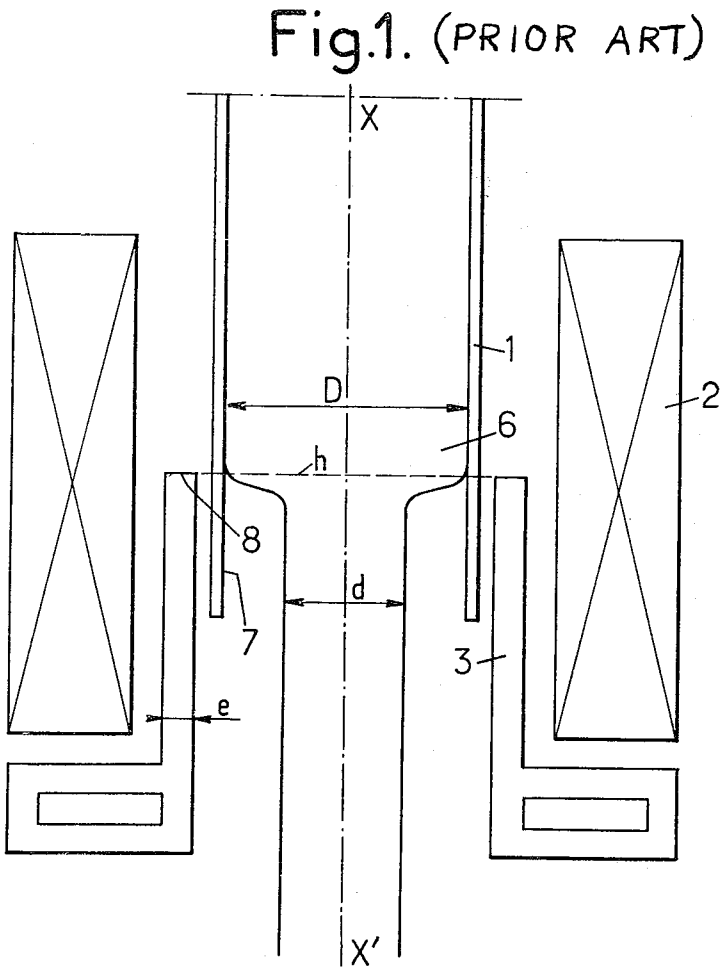
Fig.1. (PRIOR ART)
FIG. 1 is a sectional view of a prior art device.

Reference is first of all made to FIG. 1 which shows the state of the art according to the previously-mentioned French patent application no. 2,315,026, and particularly FIG. 1 of this patent application, so as to better more clearly distinguish between the present invention and the application.

In FIG. 1 hereof, the same reference numerals and letters as in FIG. 1 of the above-mentioned patent application have been used.

The device of the earlier application comprises a nozzle 1 which is advantageously cylindrical and has an outlet of diameter D.

A coil 2 having the same axis X–X′ as the nozzle 1 surrounds the latter and coil is supplied with a high-frequency alternating current by non-illustrated means.

A screen 3 which is also cylindrical and again has the axis X–X′, and extends into the coil 2 from the bottom as seen in the direction of flow of the jet of liquid metal 6. The screen 3 is made from a material such as copper having a good electrical conductivity.

In accordance with French patent application no. 2,316,026, the jet of liquid metal 6 leaving the nozzle 1 separates from the walls 7 of the nozzle 1 at the level h of the upper edge 8 of the screen 3. The jet 6 is thus contracted or confined and assumes a diameter d less than the diameter D below the level h. The position at which the jet 6 separates from the nozzle 1 can be accurately fixed by adjusting the position of the upper edge 8 of the screen 3. Furthermore, the diameter d of the jet 6 can be adjusted by regulating the high-frequency alternating current flowing through the coil 2.

In accordance with the above-mentioned patent application, the confinement is achieved by the combination of coil 2 and screen 3 under the condition that the frequency f of the current which flows through the coil 2 satisfies the following relationships:

$$f > \frac{1}{\pi\mu\sigma_m R^2} \text{ and } f > \frac{1}{\pi\mu\sigma_c e^2}, \text{ where}$$

R is the radius of the liquid metal jet 6 before its contraction (R=D/2), e is the thickness of the metal screen 3, $\sigma_m$ and $\sigma_c$ the are respective electrical conductivities of the liquid metal forming the jet 6 and the electrically conducting material forming the screen 3 and $\mu$ is the magnetic permeability of the liquid metal. The contraction coefficient $\alpha$ is equal to the ration d/D or r/R (with r=d/2).

Figure 3:
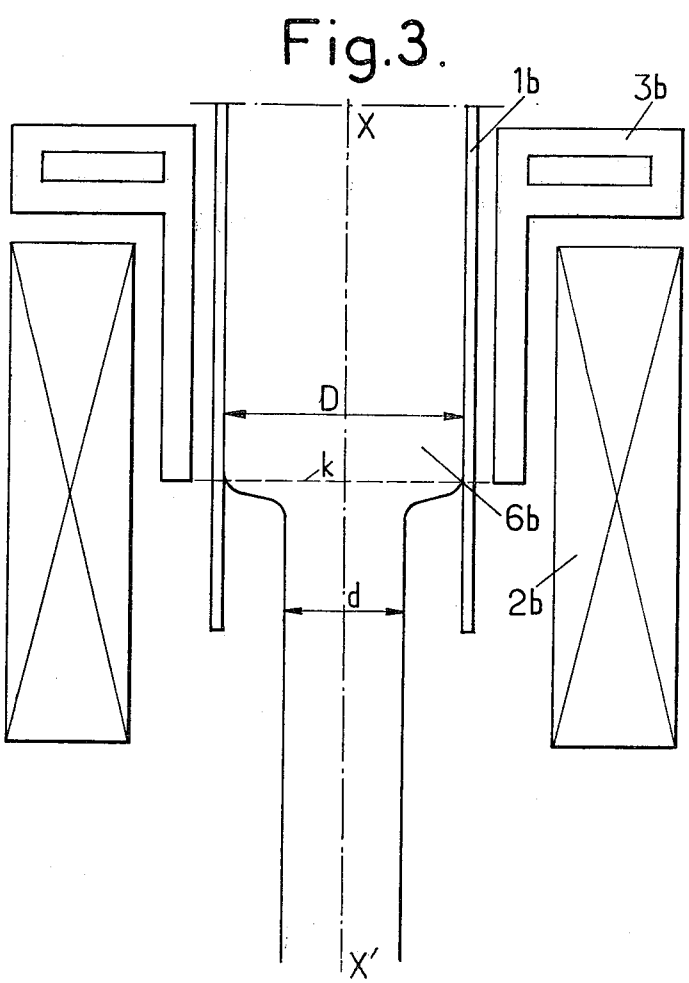

Referring now to FIGS. 2 to 4, three embodiments of a device according to the invention will be described.

FIG. 2 schematically illustrates the simplest embodiment, i.e. a device without a screen which uses only a coil supplied with an alternating current of sufficiently low frequency to ensure separation of a liquid metal jet at the outlet of a nozzle.

In FIG. 2, 1*a* is a nozzle and 2*a* a coil. A jet undergoes a change from a diameter D before confinement to a diameter d under the influence of the magnetic field produced by the coil 2*a* when the latter is supplied with an alternating current of a frequency f such that the depth of penetration of the magnetic field into the liquid metal jet 6*a* is greater than the radius r of the confined liquid metal jet 6*a* (r=d/2). Preferably, as will be explained hereafter, the frequency f is close to an optimum frequency $f_o$ such that the depth of penetration is equal to the radius R of the non-confined liquid metal jet 6*a*. The optimum frequency $f_o$ is given by the following relation:

$$f_o = \frac{}{\pi\mu\sigma_m R^2}$$

The applicant has discovered that, under these conditions, the separation takes place at a level j slightly above the coil 2*a* which may be flat and comprise only one wire wound in a flat spiral.

The reasons why the separation occurs in this manner will be explained hereafter with reference to FIGS. 5, 6 and 7.

In FIG. 3, there is illustrated an embodiment of the invention comprising, in addition to the coil which is supplied with an alternating current of low-frequency (as defined above with reference to FIG. 2), a screen made from a material having good electrical conductivity.

FIG. 3 illustrates a nozzle 1*b*, coil 2*b* and screen 3*b* which are all cylindrical about the axis X–X′. A jet of liquid metal 6*b* undergoes a change from a diameter D before contraction to a diameter d after contraction, the contraction and separation taking plate at a level k defined by the lower edge of the screen 3*b* which, contrary to the prior art screen 3 of FIG. 1, extends into the coil 2 from the top as seen in the direction of flow of the jet 6*b*.

FIG. 4 shows a device without a screen which provides for passage across a joint. Here, there is illustrated an assembly 11 consisting of a pair of pipes 11*a* and 11*b* which are separated by a gap 11*c* and are cylindrical about an axis X–X′. To achieve separation of a jet 16 at the level of the joint or gap 11*c* between the pipes 11*a* and 11*b*, the invention provides two coils 12*a* and 12*b* which are supplied with a low-frequency alternating current. The coils 12*a* and 12*b* are mounted in series so that the same current flows therethrough at all times but in opposite directions. Each coil 12*a* and 12*b* provides a screen effect with respect to the other. Thus, the fact that the directions of current flow in the coils 12*a* and 12*b* are opposite causes a zero magnetic field to exist on their common axis X–X′ midway between them. Under these conditions, separation takes place at the level of the upper surface a of the upper coil 12*a* whereas renewed contact takes place at the upper surface b of the lower coil 12*b*. The upper surface a and b of the two coils 12*a* and 12*b* are equidistant from the joint 11*c*.

Modes of implementation of the invention having been illustrated with reference to FIGS. 2, 3 and 4, the operation of these devices and the reasons for the confinement will now be explained with reference to FIGS. 5, 6 and 7.

The low-frequency confinement of the invention results from the invariance of the two magnitudes flow rate Q=SV and hydrostatic pressure heat $$H = \frac{P}{\rho g} + \frac{V^2}{2g},$$

on the one hand, and from the creation of overpressure inside the stream of liquid metal by the magnetic fields of the coils 2*a*, 2*b* and 12*a*, on the other hand.

It is the discontinuance of this overpressure which causes the confinement and thus the separation. The reduction of the pressure inside the liquid metal stream, that is, of P, causes an increase in the flow speed V of the jet because of the constancy of H (parameters $\rho$ and g being constants. Since the flow rate Q is constant, the increase in V causes a reduction in S which is the cross-section of the jet.

In the case of high frequencies (French patent application no. 2,316,026), the electromagnetic overpressure can only be canceled by canceling out the magnetic field itself by means of a screen or by means of a second coil supplied with a current flow in a direction opposite to that flowing through the first coil. In contrast, the use of a low-frequency alternating current permits the overpressure to be nullified without canceling out the magnetic field. This is achieved by reducing the efficiency of the magnetic field to zero.

In the case where the depth of penetration $\delta$ of the magnetic field into a liquid metal stream is less than the radius of the latter, an overpressure $B_o^2/2\mu$ appears at the center of the stream (if Bo designates the effective value of the magnetic field at the surface of the stream) since the magnetic field is perfectly zero at the center of the stream. On the other hand, if the depth of penetration $\delta$ is greater than the radius of the metal stream, the magnetic field has a non-zero intensity $B_a$ at the center of the stream. The overpressure which then appears in the metal stream is written:

$$\Delta P = \frac{B_o^2}{2\mu} - \frac{B_a^2}{2\mu} \quad \frac{B_o^2}{2\mu}$$

which corresponds to a drop in efficiency of the magnetic field.

If it is assumed that the depth of penetration $\delta$ is just equal to the radius R of the non-contracted metal stream and the magnetic field is zero at the center of the stream, there appears, immediately below the lower edge of the screen, an electromagnetic overpressure $$P = \frac{B_o^2}{2\mu}.$$

If the metal stream begins to contract upstream of this zone (which it will, of necessity, due to the confined effects of gravity, the decrease in magnetic intensity inside the coil and the instabilities which exist at the surface of the stream), the depth of penetration becomes locally greater than the radius of the metal stream and the efficiency of the magnetic field diminishes since Ba ceases to be zero. The result is a pressure reduction in the stream which leads to a local increase in speed and to spreading of the original contraction. The process continues and the contraction spreads along the stream. The point of separation rises up into the screen where it cannot remain stable because of the uniformity of the magnetic field and eventually becomes to become stationary at the level of the lower edge of the screen beyond which the zero value of the magnetic field would force it to upwards again.

The phenomenon is reversible and may lead to expansion of a free liquid metal stream which, far upstream of the coil, does not experience the magnetic field but undergoes an increase in pressure as it approaches the same. This increase in pressure causes a reduction in speed and consequently an increase in cross-section. Such expansion is used in the region of a joint as in FIG. 4 to cause a contracted stream of metal to again contact the walls of a pipe or nozzle.

For a magnetic field with an effective value Bo and a metal stream with an initial speed Vo, the contraction $\alpha$, which is a ratio involving the diameters before and after contraction, is given by $$\alpha = \left(1 + C_f \frac{B_o^2}{\mu\rho V_o^2}\right)^{-\frac{1}{4}}$$

The inverse of $\alpha$ is the coefficient of expansion.

The coefficient $C_f$ takes into account the fact that, contrary to the case of high frequencies, the ratio of the depth of penetration to the radius R of the metal stream before confinement is not very small with respect to unity. Consequently, the average pressure in a cross-section of the metal stream can no longer be taken as $(B_o^2/2\mu)$ but is equal to $C_f(B_o^2/2\mu)$ where $$C_f = 1 - R_\omega^{-\frac{1}{2}}(1 - e^{-R_\omega^{\frac{1}{2}}})$$

and $R_\omega = 2\pi\mu\sigma f R^2$.

By way of example, the two tables which follow give values of the coefficient of contraction $\alpha$ and the coefficient of flow rate reduction $\beta = \phi/\phi o$ ($\phi$ and $\phi o$ respectively designating the flow rates with and without a magnetic field) at a different values of $B_0$ for a liquid steel stream under a pressure head of 1 m of liquid having an initial diameter of 40 mm.

| $B_o$ (gauss) | 500 | 1000 | 1500 | 2000 | 2500 | 3000 |
|---|---|---|---|---|---|---|
| $\alpha$ | 0.99 | 0.97 | 0.94 | 0.88 | 0.79 | 0.57 |
| $B_o$ (gauss) | 500 | 1000 | 1500 | 2000 | 2500 | 3000 |
| $\alpha$ | 0.99 | 0.95 | 0.88 | 0.78 | 0.62 | 0.33 |

The values $C_f$ for this particular case are shown in FIG. 5 where frequency in kHz are the abscissa and $C_f$ is ordinate.

Insofar as the value of the optimum frequency is concerned, i.e.

$$f_o = \frac{1}{\pi\mu\sigma_m R^2},$$

the basis for this value will be explained with reference to FIGS. 6 and 7. It will be recalled that $f_o$ corresponds to the case where $\delta = R$.

Figure 6:
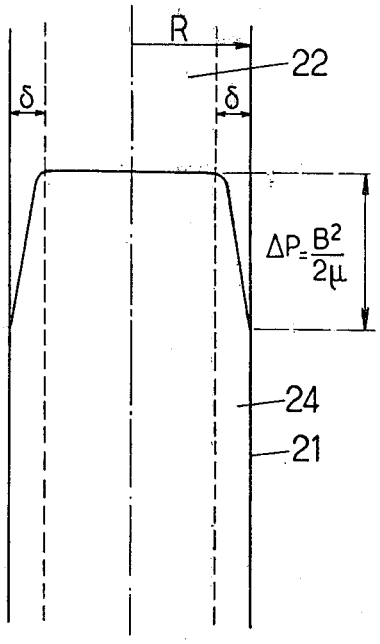
FIGS. 6 and 7 explain the contraction phenomenon when using the process of the invention.
Figure 7:
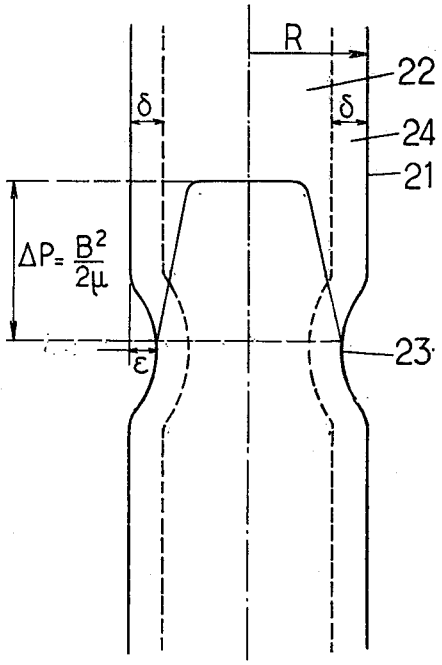

In FIGS. 6 and 7, the reference numeral 21 intentifies the peripheral surface of a jet 22 having a radius R. As shown at 23, the jet 22 is undergoing an initial contraction of amplitude $\epsilon$. The depth of penetration $\delta$ of the magnetic field into the jet 22 is indicated by the reference numeral 24.

According to the curve of FIG. 5 which shows $C_f$ as a function of frequency f, it would seem advisable to select as high a frequency f as possible so as to increase the efficiency of the device by approaching a uniform pressure profile in the metal stream as closely as possible ($\delta \rightarrow 0$). This is true without further consideration for a "high-frequency" device with a screen. However, in a "low-frequency" device, it is the local lack of efficiency of the magnetic field which is used. This leads to the addition consideration below.

If it is assumed (FIG. 6) that the frequency is such that $\delta$ is very much less than R, then any initial contraction (for example, a contraction due to a disturbance of amplitude $\epsilon$) subjected (FIG. 7) to the same electromagnetic overpressure $B^2/2\mu$ which prevents the contraction from being maintained and leads to a return to the initial radius R. Thus to be certain that there is a decrease in overpressure at the level of any initial contraction which will permit the same to be amplified and thereby allow confinement, it is necessary to comply with the condition $\delta \geqq R$, i.e.

$$f \leqq \frac{1}{\pi\mu\sigma R^2}.$$

Since, as explained above, f should be as large as possible, the optimum frequency is then $$f = \frac{1}{\pi\mu\sigma R^2}$$

which corresponds to $\delta = R$.

The process and device of the invention permit liquid metals, particularly steel aluminium, copper and alloys thereof, to be confined.

The process and device of the invention further make it possible to contract a jet of molten metal, particularly steel, aluminium, copper and alloys thereof, leaving an orifice a small diameter (a few millimeters).

The invention also enables a jet of molten metal to be passed across a joint.

The invention additionally permits the following advantages to be achieved:

an orifice having a relatively large diameter, i.e. sufficiently large to prevent blockage may be used, to form a jet of relatively small diameter;

billets of small diameter (a few millimeters), or even wires, may be formed by contracting a jet of molten metal at an outlet orifice, e.g. an outlet of a casting ladle;

a jet may be contracted at a joint between two elements thus allowing a liquid metal to pass smoothly across the joint between a first element and a second element;

one of the steps of the usual wire-drawing operation may be eliminated by making the diameter of a jet smaller than that of an orifice through which the jet passes thereby allowing the capital and operating costs of a wire-drawing installation to be reduced. Thus, rough metal wire shapes (steel and aluminum wires for example) may be produced from a liquid metal directly if cooling means are provided for solidifying the contracted jet;

joining and sealing problems at joints may be resolved by maintaining the free surface of the liquid metal at a spacing from the joint: a particular application is the avoidance of the junction problems which arise when ingot moulds for the continuous horizontal casting of steels are supplied with molten steel;

the flow rate of a jet of liquid metal through an outlet orifice at the bottom of a container for the liquid metal may be regulated.

The device of the invention may be readily adapted to existing installations since neither the coil nor the screen must have a special geometry or specific dimensions.

The invention is not limited to the applications and embodiments which have been described and illustrated but; embraces all variations thereof.

I claim:

1. A method of contracting a stream of molten metal comprising the steps of:

(a) conveying said stream along a path having an upstream portion and a downstream portion, said stream having a predetermined cross-sectional area in said upstream portion; and (b) reducing said cross-sectional area in a region between said upstream and downstream portions so that said stream has a lesser cross-sectional area in said downstream portion than in said upstream portion, the reducing step including surrounding said region with an electromagnetic field generated by an alternating current having a frequency less than the inverse of the following product:

(magnetic permeability of said stream)×(electrical conductivity of said stream)×(square of the radius of said stream in said downstream portion of said path).

2. A method as defined in claim 1, wherein said frequency is substantially equal to the inverse of the following product:

(magnetic permeability of said stream)×(electrical conductivity of said stream)×(square of the radius of said stream in said upstream portion of said path).

3. A method as defined in claim 8, wherein said path has a junction in said downstream portion and another electromagnetic field surrounding said path is created downstream of said junction to increase said lesser cross-sectional area, said other electromagnetic field being generated by an alternating current having said frequency but flowing in a direction opposite to the alternating current of the reducing step.

4. A method as defined in claim 1, wherein said metal comprises steel, aluminum, copper or alloys thereof.

5. An arrangement for contracting a stream of molten metal comprising:

(a) wall means defining a flow path for the stream;

(b) coil means including at least one coil which surrounds said wall means and is arranged to generate an electromagnetic field around said path; and (c) current supply means for supplying to said coil means an alternating current having a frequency which is less than the inverse of the following product:

(magnetic permeability of the stream)×(electrical conductivity of the stream)×(square of the radius of the stream after passing through said one coil).

6. An arrangement as defined in claim 5, wherein said current supply means is arranged to supply an alternating current having a frequency substantially equal to the inverse of the following product:

(magnetic permeability of the stream)×(electrical conductivity of the stream)×(square of the radius of the stream prior to passing through said one coil).

7. An arrangement as defined in claim 5, wherein said one coil is spaced from said wall means and an electrically conducting screen projects into the gap between said wall means and said one coil through the upstream end of the latter.

8. An arrangement as defined in claim 7, wherein said one coil and said screen are substantially concentric.

9. An arrangement as defined in claim 5, said wall means having a junction and said one coil being located upstream of said junction; and wherein said coil means includes another coil downstream of said junction, said other coil surrounding said wall means and being arranged to generate an electromagnetic field around said path, and said other coil being connected to said current supply means in such a manner that the direction of current flow therethrough is opposite to that through said one coil.

10. An arrangement as defined in claim 5, wherein said one coil is spaced from said wall means and the gap between said one coil and said wall means is clear.

* * * * *